US007547260B2

(12) United States Patent
Mooney

(10) Patent No.: US 7,547,260 B2
(45) Date of Patent: Jun. 16, 2009

(54) BATTING CAGE

(76) Inventor: Bert E. Mooney, 2742 Sea Pines Cir., Clearwater, FL (US) 33761

( * ) Notice: Subject to any disclaimer, the term of this patent is extended or adjusted under 35 U.S.C. 154(b) by 0 days.

(21) Appl. No.: 11/446,559

(22) Filed: Jun. 2, 2006

(65) Prior Publication Data

US 2006/0293124 A1 Dec. 28, 2006

Related U.S. Application Data

(60) Provisional application No. 60/694,729, filed on Jun. 28, 2005.

(51) Int. Cl.
*A63B 69/00* (2006.01)

(52) U.S. Cl. ..... 473/421; 473/451; 473/422

(58) Field of Classification Search ..... 473/422, 473/421, 423, 430, 454, 451, 452, 270, 269, 473/266, 262; 273/317.8, 334, 335, 331, 273/34, 410

See application file for complete search history.

(56) References Cited

U.S. PATENT DOCUMENTS

| | | | | | |
|---|---|---|---|---|---|
| 1,554,409 | A | | 9/1925 | Coffee | |
| 2,839,300 | A | | 6/1958 | Blaha et al. | |
| 2,915,314 | A | * | 12/1959 | Phillips | 273/410 |
| 3,442,510 | A | | 5/1969 | Sorenson | |
| 3,475,025 | A | * | 10/1969 | Uphaus | 473/421 |
| 3,593,998 | A | * | 7/1971 | Pattyn | 473/430 |
| 3,716,235 | A | * | 2/1973 | Yerkie, Jr. | 473/429 |
| 3,994,494 | A | * | 11/1976 | Kelley | 473/430 |
| 4,127,267 | A | | 11/1978 | Bay et al. | |
| 4,489,941 | A | * | 12/1984 | Shieh | 473/197 |
| 4,521,016 | A | * | 6/1985 | Tominaga | 473/430 |
| 4,632,394 | A | * | 12/1986 | Ryan | 473/421 |
| 4,733,865 | A | * | 3/1988 | Reed | 473/421 |
| 4,828,262 | A | * | 5/1989 | Henley | 473/429 |
| 4,872,674 | A | * | 10/1989 | Deal | 473/435 |
| 4,993,709 | A | | 2/1991 | Tominaga | |
| 5,040,791 | A | | 8/1991 | Ratajac et al. | |
| 5,577,721 | A | * | 11/1996 | Hardee et al. | 473/421 |
| 5,624,113 | A | | 4/1997 | Rabine | |
| 5,743,820 | A | | 4/1998 | Espinosa | |
| 5,755,630 | A | * | 5/1998 | Malwitz | 473/429 |
| 5,795,250 | A | | 8/1998 | Cripe | |
| 5,795,251 | A | * | 8/1998 | Andersen | 473/427 |
| 5,882,270 | A | | 3/1999 | Daugherty | |
| 5,944,318 | A | * | 8/1999 | Payton | 273/402 |
| D431,061 | S | | 9/2000 | Solis | |
| 6,168,540 | B1 | | 1/2001 | McKenna | |
| 6,676,532 | B1 | * | 1/2004 | Boulton et al. | 473/197 |
| D486,544 | S | | 2/2004 | Featherston | |
| 6,729,978 | B2 | | 5/2004 | Moss et al. | |
| 6,729,981 | B1 | * | 5/2004 | Clifton | 473/468 |

* cited by examiner

*Primary Examiner*—Mitra Aryanpour
(74) *Attorney, Agent, or Firm*—Banner & Witcoff, Ltd

(57) ABSTRACT

A batting cage device comprises vertically arranged first and second panels forming an included angle with a ball tethered between the panels to enable a hitter to hit the ball into one of the panels from which it will rebound with various spins and other characteristics to improve the skill of the batter or hitter.

11 Claims, 4 Drawing Sheets

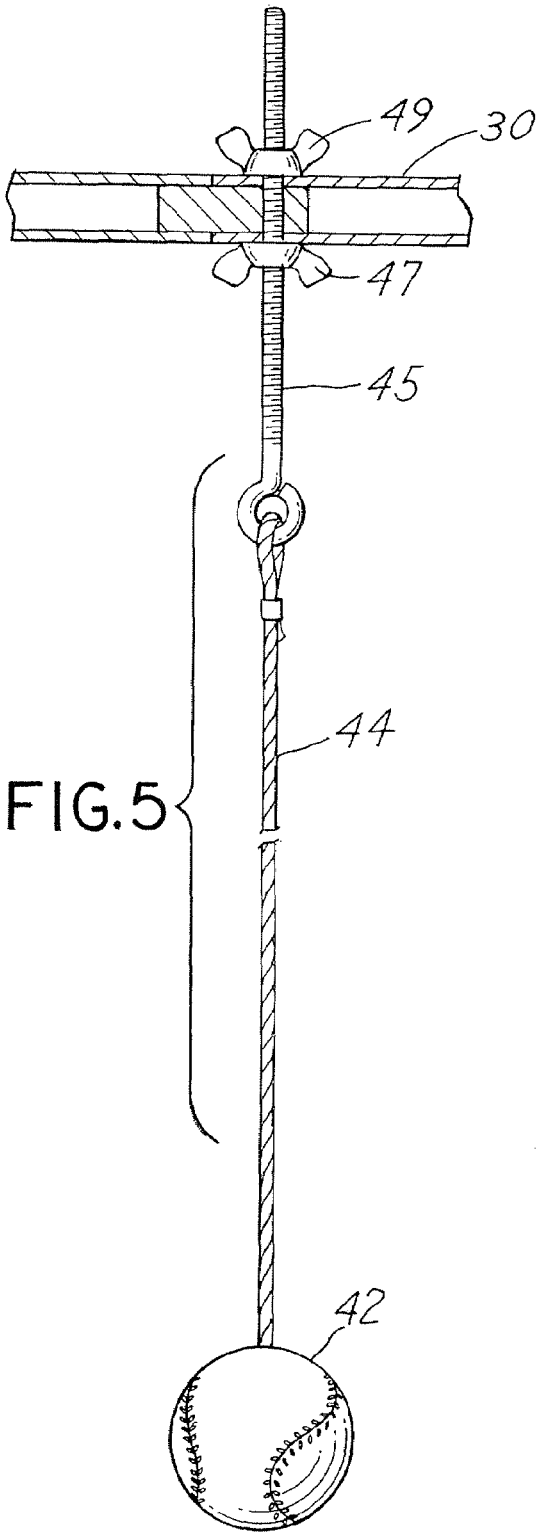
FIG.5
FIG.6
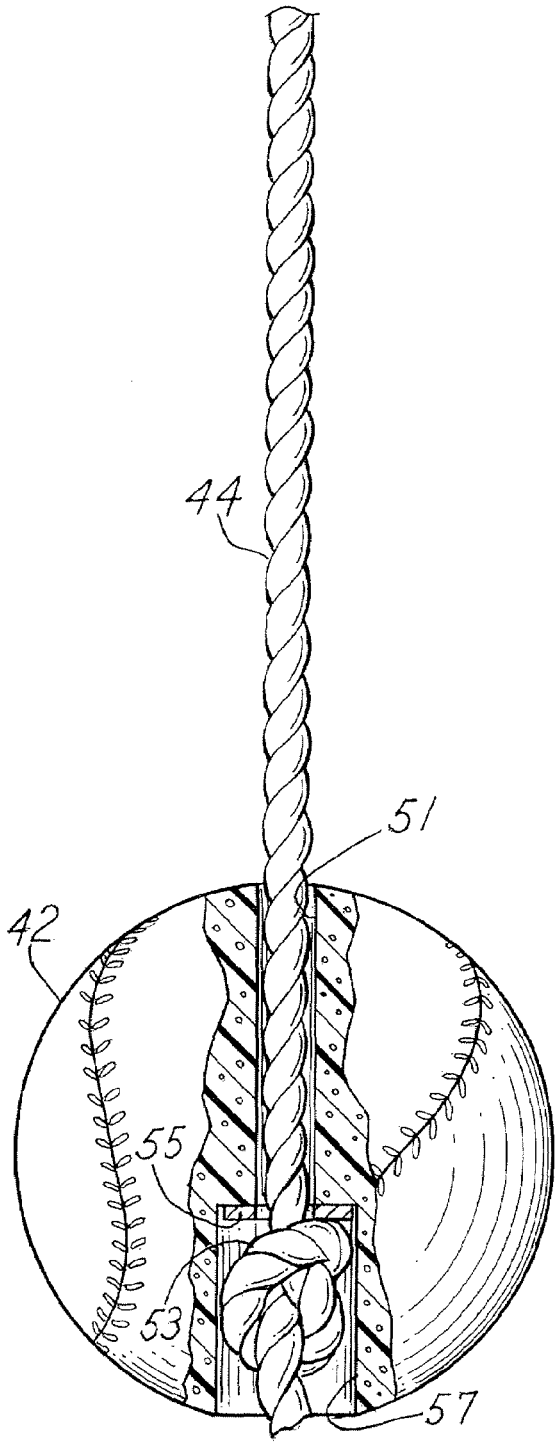

BATTING CAGE

CROSS REFERENCE TO RELATED APPLICATION

This is a utility application based, in part, upon previously filed provisional application Ser. No. 60/694,729 filed Jun. 28, 2005 entitled "Batting Cage" which is incorporated herewith by reference and for which priority is claimed.

BACKGROUND OF THE INVENTION

In a principal aspect the present invention relates to a batting cage for improving skills in involving the striking of a ball, particularly a baseball, a tennis ball and the like.

Baseball, softball, tennis and other sports typically involve striking a ball with a bat, a racquet or the like. Such sports also require multiple participants, such as a pitcher, catcher, etc., or an opponent. Thus, practice of the skills required in order to participate in such sports may well be limited unless a device or apparatus is made available which will enable an individual to hone their skills. In this regard, numerous patents and products have been developed which involve striking of a practice ball into a net. The net may react elastically, causing the ball to rebound. Upon the rebound the ball may be struck once again. Devices of this nature are represented by the following patents:

| U.S. PAT. NO. | ISSUE DATE | TITLE |
|---|---|---|
| 1,554,409 | Sep. 22, 1925 | Batting Device |
| 2,839,300 | Jun. 17, 1958 | Baseball Batting Practice Device |
| 3,442,510 | May 6, 1969 | Exercise Device with Tethered Projectile |
| 4,127,267 | Nov. 28, 1978 | Collapsible Frame with Hanging Net Ball Arresting Apparatus |
| 4,993,709 | Feb. 19, 1991 | Ball Game Apparatus |
| 5,040,791 | Aug. 20, 1991 | Batting Cage |
| 5,624,113 | Apr. 29, 1997 | Portable Batting System |
| 5,743,820 | Apr. 28, 1998 | Batting Practice Device with Adjustable Mounting Means |
| 5,795,250 | Aug. 18, 1998 | Tethered Ball Practice Device |
| 5,882,270 | Mar. 16, 1999 | Baseball Batting Practice Device |
| 6,168,540 | Jan. 2, 2001 | Portable Apparatus for Practicing Batting |
| 6,729,978 B2 | May 4, 2004 | Ball Hitting Practice Apparatus |
| D431,061 | Sep. 19, 2000 | Support Stand for Athletic Training Device |
| D486,544 S | Feb. 10, 2004 | Batting Practice Stand |

While such devices are highly useful for the honing of one's skills, there is a deficiency associated with such devices. That is, such devices do not necessarily replicate the many and varied characteristics of a ball being returned from an opponent or being thrown by a pitcher, for example. That is, such balls in competitive situations will typically have spin and may have other characteristics in terms of how the ball moves toward the individual who intends to strike the ball. Striking such a ball in a manner which will direct the ball as desired while compensating for the particular spin, angle and other movement of the ball requires practice in order to develop appropriate skills. Thus, there has developed a need to provide a device or apparatus which will enable an individual to develop improved ball striking skills.

SUMMARY OF THE INVENTION

Briefly, the present invention comprises a batting cage which includes at least two generally vertical, side rebound panels arranged in an angular relationship so that a ball tethered on a cord or otherwise suspended between the panels may be struck to impact one of the panels and then rebound. The tethered ball, when so suspended, will rebound at various angles and with various spins, speeds and movement. As a result, an individual positioned between the panels and striking the ball will be exposed to innumerable types of ball movement and thereby may develop appropriate skills in order to strike the ball in a desired manner. An embodiment includes a further generally horizontal top panel spanning the side panels above a hitting zone.

Thus, it is an object of the invention to provide an improved skill development system for individuals that desire to strike a ball having various flight, spin and other movement and/or compositional characteristics.

It is a further object of the invention to provide a batting cage for practice of baseball skills wherein the cage is comprised of at least two angled panels so that a ball tethered between the panels may be struck and rebound from one or both of the panels in a variety of patterns.

Another object of the invention is to provide a batting cage or ball practice device wherein the device is easy to assemble, inexpensive, rugged and capable of use by a wide range of individuals having a broad range of skills, physical size and strength.

Yet another object of the invention is to provide an improved batting cage wherein the cage is comprised of first and second panels as well as a top panel with a ball suspended between the panels so that an individual positioned in front of the angled side panels and in opposition to the ball tethered on a cord suspended between the side and top panels may strike the ball and drive it into at least one of the panels so that it will rebound.

Another object of the invention is to provide a device wherein elastically responsive panels and/or a ball will rebound in various ways so that the ball suspended from a tether may exhibit various characteristics of spin, speed and the like.

These and other objects, advantages and features of the invention will be set forth in the detailed description which follows.

BRIEF DESCRIPTION OF THE DRAWINGS

In the detailed description which follows, reference will be made to the drawing comprised of the following figures:

FIG. 5 is a partial front plan view of the embodiment depicting the ball tether;

FIG. 6 is a partial plan view of the tether assembly for a ball; and

DESCRIPTION OF A PREFERRED EMBODIMENT

Figure 1:
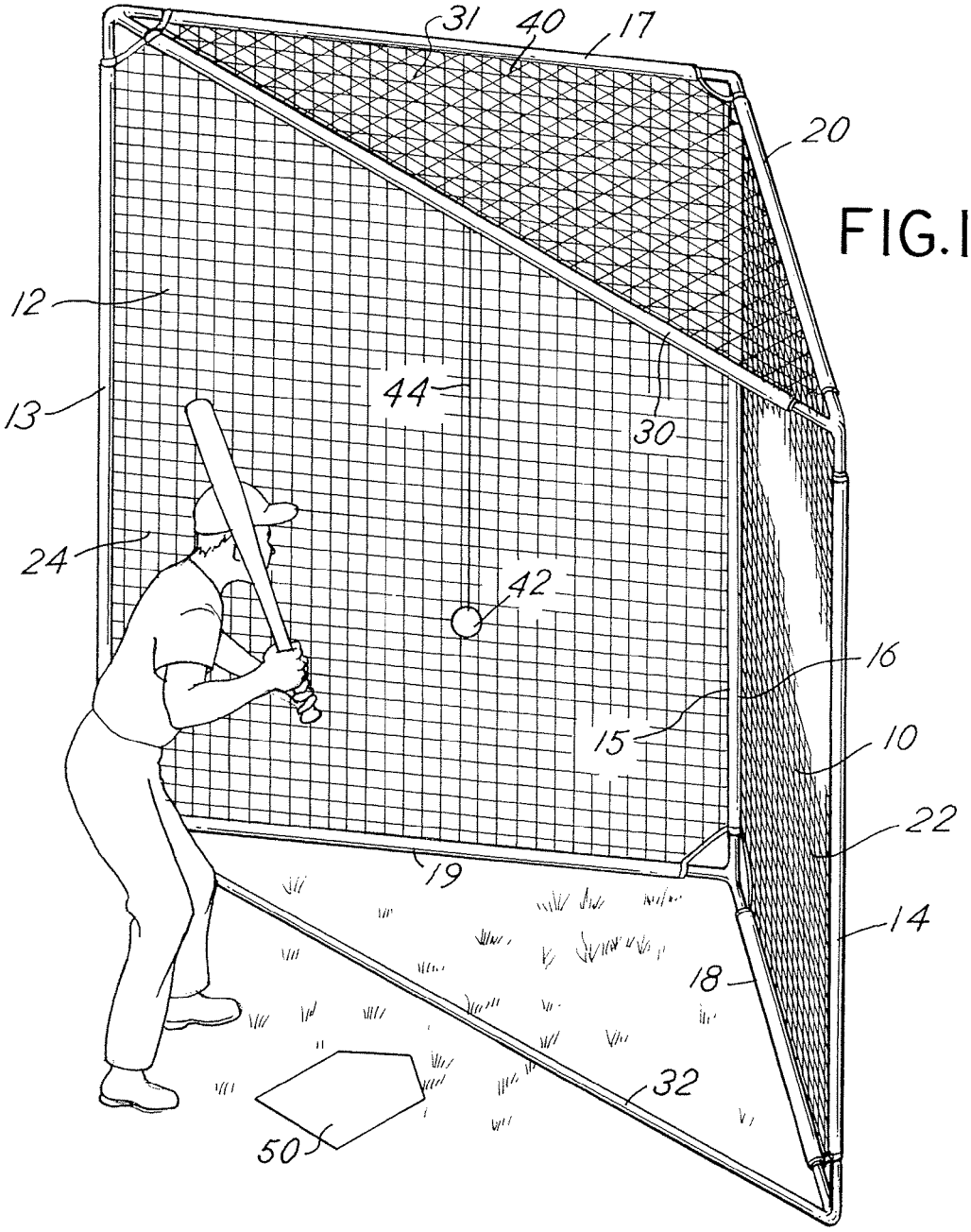
FIG. 1 is an isometric view of an embodiment of the invention featuring multiple panels and a ball tethered in opposition to the panels for engagement by a bat, racquet or the like and illustrating the manner of use of the embodiment.
Figure 3:
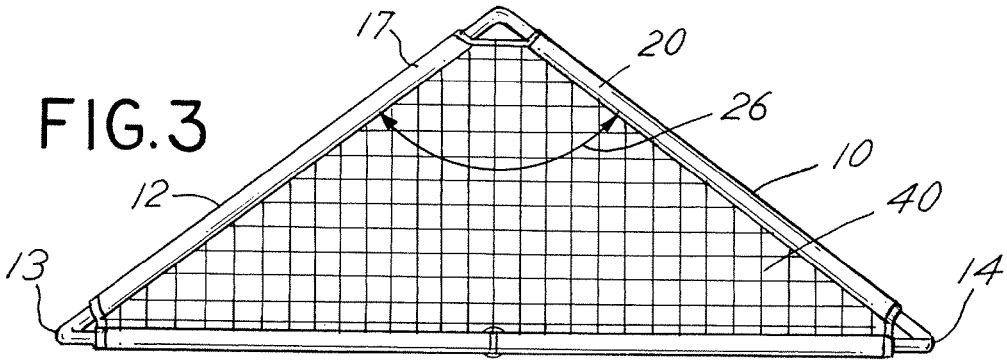
FIG. 3 is a top plan view of the embodiment of FIG. 1.
Figure 2:
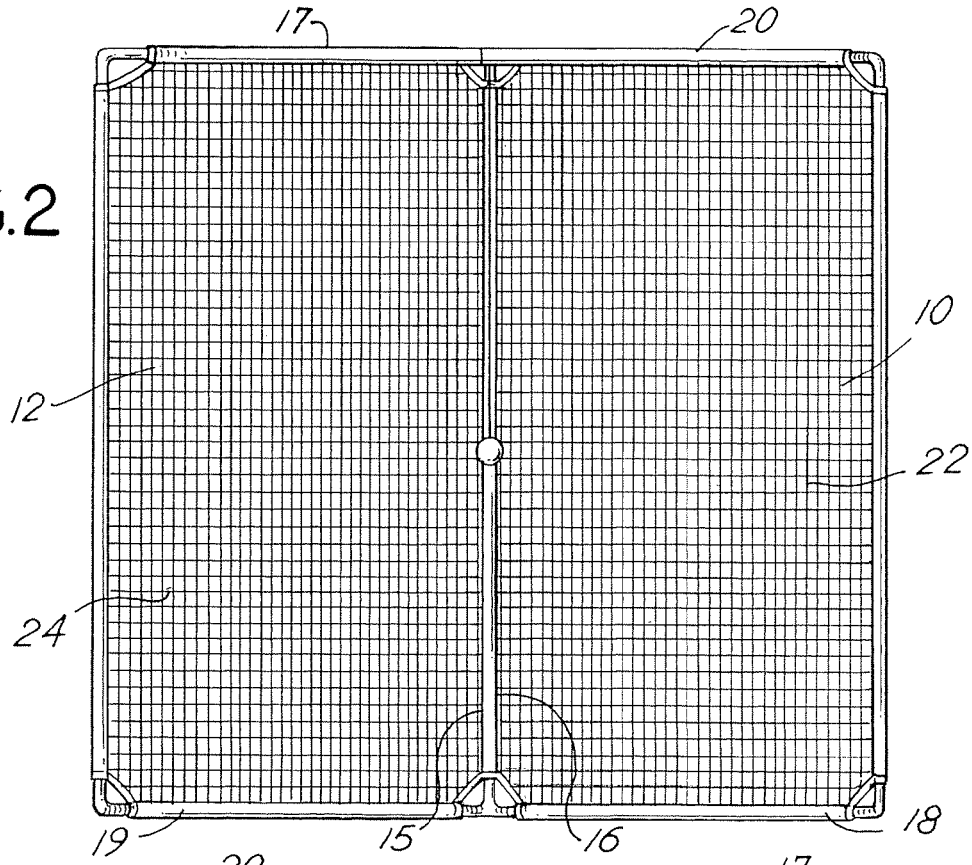
FIG. 2 is a front elevation of the embodiment of FIG. 1.
Figure 4:
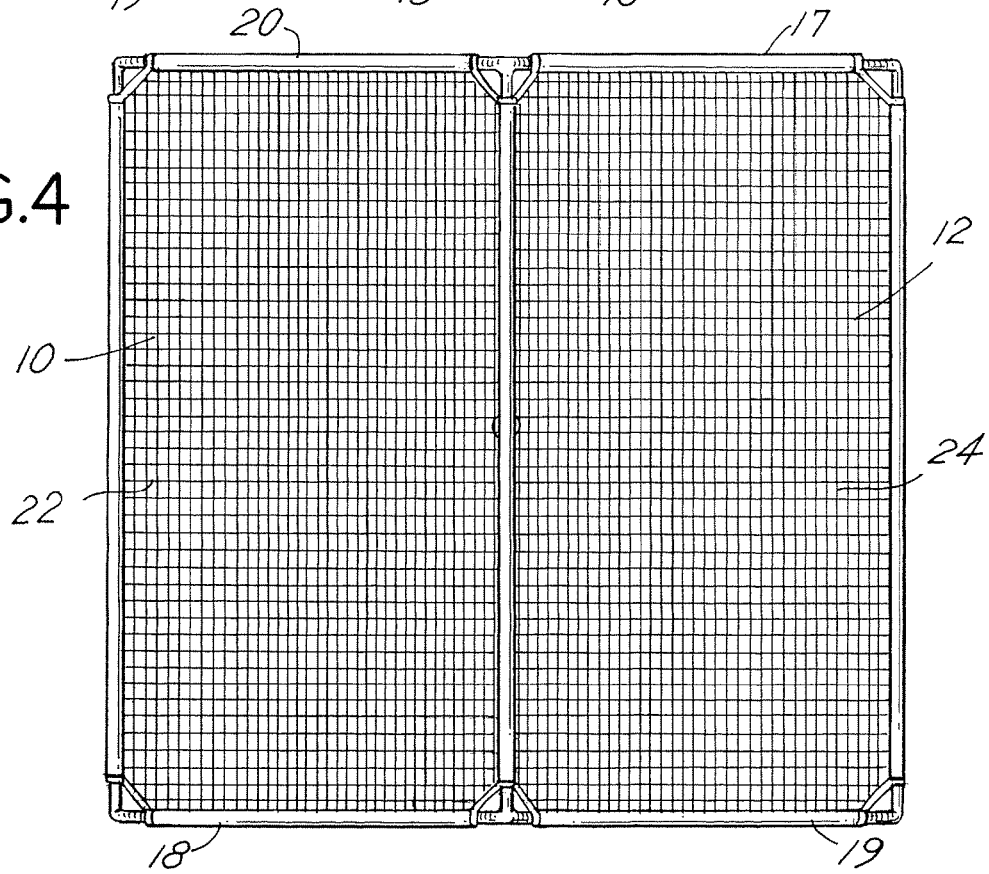
FIG. 4 is a back side elevation of the cage of the embodiment of FIG. 1.

Referring to the figures, a typical batting or ball striking cage or construction employing features of the invention is comprised of a first generally vertical panel 10 and a second generally vertical panel 12. The panels 10 and 12 are each comprised of a generally rectangular frame including a first lateral side 14 and a spaced, second lateral side 16, a bottom side 18, and a top side 20 for the panel 10. Similarly, the panel 12 includes a first lateral side 13, a second lateral side 15, a top side 17 and a bottom side 19. The described combinations of four sides are joined together to form generally rectangular panels and each panel 10 or 12 includes a netting material 22 and 24, respectively, filling the region in the frames 10 and 12 defined by the sides. The netting material 22, 24 is generally elastic and the choice of the material may be varied in order to change the elastic characteristics of the panels 10 and 12, e.g. the elastic material of panel 22 may be distinct from the elastic material of panel 24. Examples of netting material include type 728 nylon having a coefficient of elasticity in the range of about −4×10 −5 to −7.2×10.5. The panels 10 and 12 are joined together along the vertical sides or posts 15 and 16 and define an included angle 26. The included angle 26 may be varied depending upon the rebound characteristics which are to be faced with respect to the batting cage construction. Typically, the angle 26 is an obtuse angle greater than 90°, but less than 180°.

The frames 10 and 12 are maintained in the appropriate angular relationship by means of connecting members 30 between the top sides 17 and 20 and a connecting member 32 between the bottom sides 18 and 19. All of the component parts may be preassembled or may be made from elements which can be assembled at a site of use. Preferably, the generally triangular top section or panel 31 formed by the frame members 17, 20 and 30 further includes a netting material 40. The netting material 40 may be the same material as used for panels 10 and 12 or a distinctive material having different rebound characteristics to thereby provide a rebound characteristic which is unique vis avis the material in panels 10 and/or 12. Thus, the netting or rebound material associate with each panel, 10, 12 and 31.

A ball 42 is suspended from a tether 44 preferably from the cross member 30. However, the ball 42 may be suspended at any position between the angled panels 10 and 12. Generally, the ball 42 is aligned on a bisector of an angle formed by panels 10, 12. However, to increase the variety of spins and ball position, the ball 42 may be positioned along a line separate from an angular bisector.

A batter position indicator or plate 50 may be placed on the ground in front of the batting cage between the panels 10 and 12. The tether 44 may be adjusted in length and an individual may then employ a bat, racquet or the like and strike the ball. Striking the ball will cause the ball 42 to hit one of the panels 10 and 12 or the top panel 40 and rebound. Upon the rebound, because of the reaction of the ball 42 in terms of its spin, angular relationship and speed when it strikes one of the panels will spin or otherwise move upward or downward in a manner that is not consistent or necessarily predictable. As such, repetitive hitting of the ball will lead to reaction by the individual hitting the ball improving the reflexes and resulting in the ability to appropriately react to various spins and other movements of the ball 42. Hand-eye coordination skills may then be enhanced.

As depicted for example, in FIG. 1, a batter or athlete may be aligned as a right handed batter. The ball 42 may then be struck with a bat, driving the ball into the panel 12 typically. Thus, a right handed batter will typically hit into the screen or panel 12. Left handed batters will typically hit into the right handed screen or panel, 10. Of course, hitting skills will enable batters to direct the ball toward a desired panel or screen. The ball 42 will then rebound off the screen against which it impacts. Generally, such rebound will be upward toward the top screen 31. The ball then will either rebound off of a back screen or one of the other screens. It will then fall into a strike zone. Upon its entry toward the strike zone, it will of course have particular pathway and direction, spin and other characteristics. The batter may then strike the ball 42.

The combination of the three panels or screens 10, 12 and 31 along with the tethered ball 42 suspended generally in the strike zone enables simulation of hitting activities. The length of the tether 44 may be adjusted to simulate positioning of the ball in various parts of the strike zone. For example, as illustrated in FIGS. 5 and 6, the tether 44 may be supported at one end upon an adjustable rod 45, which is held by wing nuts threadably attached to the rod, namely the wing nuts 47 and 49. The rod 45 is extended through an opening in the pole or side 30. In this manner, the tether may be adjusted upwardly or downwardly.

The tether 44 may be fastened to the ball 42 by providing a passage 51 through the ball 42 into which the tether 44 is extended with a knot 53 at one end engaged against a washer 55 in a counterbore 57 in the ball 42. Typically, the counterbore 57 will be filled with an epoxy or elastomeric material after the assembly is fashioned.

Figure 7:
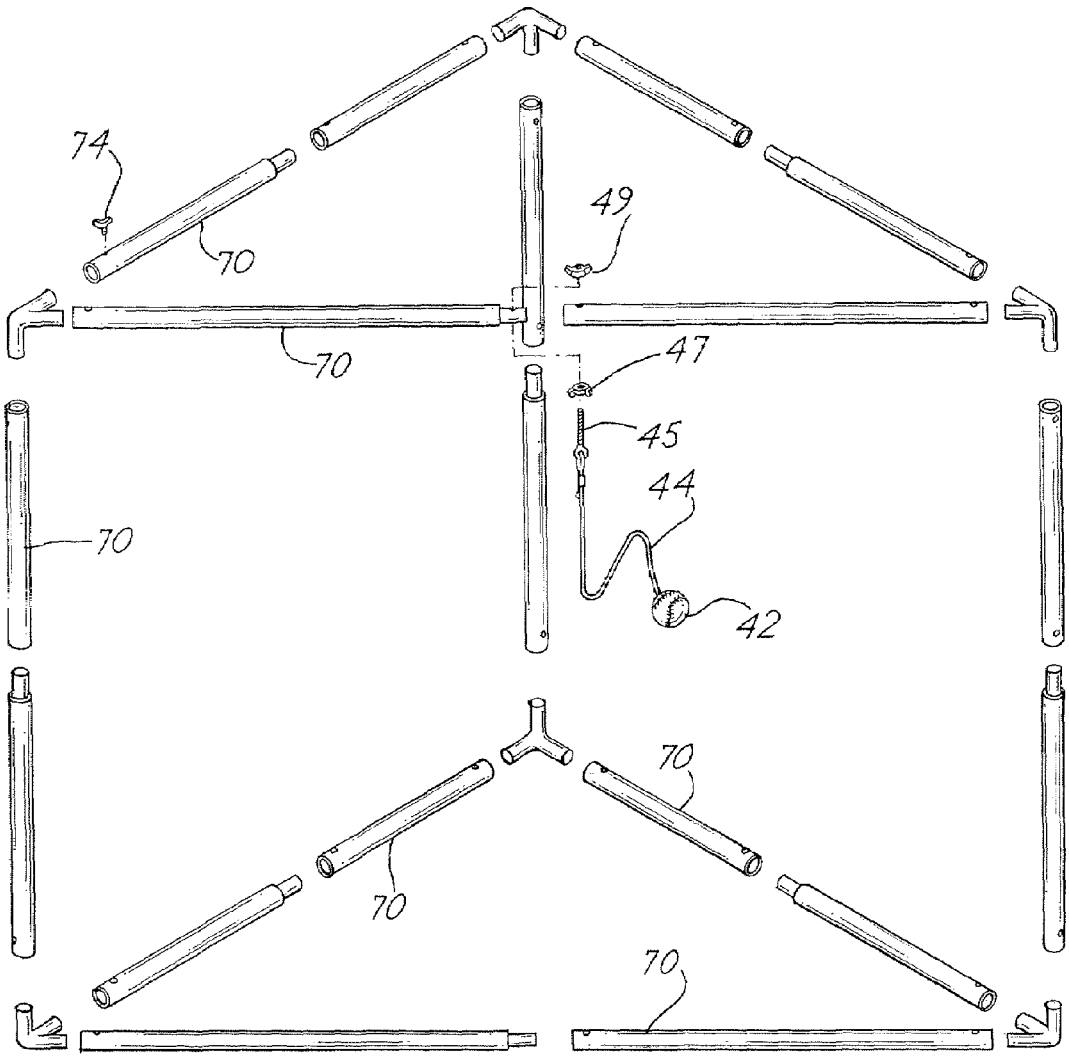
FIG. 7 is an exploded isometric view of the embodiment of FIG. 1.

As shown in FIG. 7, the component parts of the cage may be comprised of modular lengths of tubing 70 which are fitted together and connected at corners by connectors 72 held in place by fasteners 74, for example. Thus, the various sections of tubing 70 forming the frames of the panels may be joined and threaded through the mesh panel material to assemble the batting cage. The component parts may be assembled and held together by fasteners 74 such as screws or the like. The netting may comprise netting material which is fastened along the various sides to tubes which fit over the tubing comprising the sides of the structure depicted in FIG. 7. The entire assembly may therefore be easily packaged in an unassembled condition and then easily assembled by connecting the rigid modular lengths of tubing 70 forming the sides of the panels and attaching the netting material to those assembled sides.

Typically, the ball 42 is a non-elastic material. However, it may be an elastic material as a variation or alternative embodiment. Further, the netting 22 and 24 described is typically an elastic material. However, the netting 22 and 24 may be replaced by solid materials and the ball 42 may, at least be elastic to a degree, or a foam material, in order to provide the rebound capability of the ball relative to the panels 10 and 12. There are many variations of the invention which are considered to be within the scope and meaning of the appended claims. That is, the panels 10 and 12 may have different shapes and may be arranged at different heights and different angles with respect to each other. The top panel 40 may include a configuration which enables it to extend out and over the panels 10 and 12 and thus extend outwardly beyond the cross bar 30. The length of the tether 44 and the position of attachment of the tether 44 may be varied. The material associated with the ball 42 may be varied, as may be the size and even the configuration of the ball 42. Thus, the invention is to be limited only by the following claims and equivalents thereof.

What is claimed is:

1. A batting cage comprising, in combination:

a first generally flat planar rectangular frame having an upright generally vertical first side member and a generally parallel spaced second side member;

at least partially a elastic first panel of a first material, said first panel comprising a generally planar hitting area retained within the first frame;

a second generally flat planar rectangular frame having an upright generally vertical first side member, said second frame extending from and forming an included angle with the first frame, said angle including an apex, said second frame also including a generally parallel spaced second side member;

an at least partially elastic second panel of a second material, said second panel comprising a generally planar hitting area retained within the second frame, said first panel hitting area and said second panel hitting area each extending from the apex;

a top connecting member joining the second side members;

an adjustable mounting mechanism for mounting said first and second frames generally vertically upright with said frames forming an angle with each other extending outwardly from said apex at variable adjustable angles to form said first and second panels as angled hitting areas extending from said apex; and a single tethered ball adjustably suspended from said connecting member on a generally vertical, adjustable length, flexible cord within the included angle of the first and second frames, and within or at the outward extent of the first and second frames, said tethered ball cord sufficiently elongate to enable the ball to engage the elastic material in each of said frames and to rebound to said suspended position from engagement with both of said hitting areas of said first and second panels upon one movement of said ball due to hitting the ball into said first or second hitting areas wherein a batsman may engage a bat with said tethered ball when said batsman is located in the adjusted included angle of said frames to drive said ball into either of said hitting areas.

2. The combination of claim 1 wherein the ball comprises a foam material ball.

3. The combination of claim 1 further including a top frame mounted generally horizontally above the tethered ball, said top frame including an at least partially elastic panel, said top frame positioned to extend from the apex and to generally fill the adjusted included angle between the first and second frames.

4. The combination of claim 1 further including a base which subtends the first and second frames in the included angle thereof.

5. The combination of claim 1 wherein the ball is tethered along a bisector of the angle formed by the included angle formed by the first and second frames.

6. The combination of claim 1 wherein the ball is tethered outside a bisector of the angle formed by the included angle formed by the first and second frames.

7. The combination of claim 1 wherein the frames are joined at said apex and are further connected along a base line connecting the spaced sides of the frames and wherein the ball is tethered along said base line.

8. The combination of claim 1 wherein the elastic material in one frame is distinct from elastic material in the other frame.

9. The combination of claim 1 wherein the ball is tethered on the flexible cord suspended intermediate the generally vertical panels generally midway therebetween along a bisector of an angle formed by said panels.

10. The combination of claim 1 wherein the generally vertical panels include a common frame support member at their intersection.

11. The combination of claim 1 wherein the first material and second material are distinct materials.

* * * * *